US006681855B2

(12) United States Patent
Zupanick et al.

(10) Patent No.: US 6,681,855 B2
(45) Date of Patent: Jan. 27, 2004

(54) METHOD AND SYSTEM FOR MANAGEMENT OF BY-PRODUCTS FROM SUBTERRANEAN ZONES

(75) Inventors: Joseph A. Zupanick, Pineville, WV (US); Monty H. Rial, Dallas, TX (US)

(73) Assignee: CDX Gas, L.L.C., Dallas, TX (US)

( * ) Notice: Subject to any disclaimer, the term of this patent is extended or adjusted under 35 U.S.C. 154(b) by 126 days.

(21) Appl. No.: 10/046,001

(22) Filed: Oct. 19, 2001

(65) Prior Publication Data

US 2003/0075322 A1 Apr. 24, 2003

(51) Int. Cl.[7] ..... E21B 43/14; E21B 43/40; E21B 43/30

(52) U.S. Cl. ..... 166/268; 166/245; 166/263

(58) Field of Search ..... 166/245, 268, 166/263, 305.1, 306

(56) References Cited

U.S. PATENT DOCUMENTS

| | | | | |
|---|---|---|---|---|
| 54,144 | A | 4/1866 | Hamar | |
| 274,740 | A | 3/1883 | Douglass | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,847 | A | 3/1955 | McCune et al. | 255/1.6 |
| 2,726,063 | A | 12/1955 | Ragland et al. | 255/1.8 |
| 2,783,018 | A | 2/1957 | Lytle | 251/25 |
| 2,847,189 | A | 8/1958 | Shook | 255/76 |
| 2,911,008 | A | 11/1959 | Du Bois | 137/625.31 |
| 2,980,142 | A | 4/1961 | Turak | 137/637.3 |
| 3,347,595 | A | 10/1967 | Dahms et al. | 299/4 |

(List continued on next page.)

FOREIGN PATENT DOCUMENTS

| | | | |
|---|---|---|---|
| DE | 197 25 996 A1 | 1/1998 | E03B/3/10 |
| EP | 0 819 834 A1 | 1/1998 | E21B/43/28 |
| EP | 0 875 661 A1 | 11/1998 | E21B/43/30 |

(List continued on next page.)

OTHER PUBLICATIONS

Abstract of AU 8549964, Derwent Information Ltd. 1987.*

Arfon H. Jones et al., "A Review of the Physical and Mechanical Properties of Coal with Implications for Coal-Bed Methane Well Completion and Production", *Rocky Mountain Association of Geologists*, pp. 169–181, 1988.

(List continued on next page.)

*Primary Examiner*—David Bagnell
*Assistant Examiner*—John Kreck
(74) *Attorney, Agent, or Firm*—Baker Botts L.L.P.

(57) ABSTRACT

An improved method for management of by-products from subterranean zones, comprising drilling a first well system into a subterranean zone, wherein the first well system comprises a first drainage pattern. By-product and gas from a first volume of the subterranean zone is removed via the first well system. A second well system is drilled into the subterranean zone, wherein the second well system comprises a second drainage pattern, and by-product is moved from a second volume of the subterranean zone to the first volume of the subterranean zone. Gas is then produced from the second volume of the subterranean zone. Subsequent drainage patterns repeat the process.

28 Claims, 7 Drawing Sheets

U.S. PATENT DOCUMENTS

| | | | | | |
|---|---|---|---|---|---|
| 3,443,648 | A | | 5/1969 | Howard | 175/103 |
| 3,473,571 | A | | 10/1969 | Dugay | 137/625.4 |
| 3,503,377 | A | | 3/1970 | Beatenbough et al. | 123/117 |
| 3,528,516 | A | | 9/1970 | Brown | 175/267 |
| 3,530,675 | A | | 9/1970 | Turzillo | 61/35 |
| 3,684,041 | A | | 8/1972 | Kammerer, Jr. et al. | 175/267 |
| 3,692,041 | A | | 9/1972 | Bondi | 137/238 |
| 3,757,876 | A | | 9/1973 | Pereau | 175/267 |
| 3,757,877 | A | | 9/1973 | Leathers | 175/269 |
| 3,800,830 | A | | 4/1974 | Etter | 137/625.41 |
| 3,809,519 | A | | 5/1974 | Garner | 425/245 |
| 3,825,081 | A | | 7/1974 | McMahon | 175/73 |
| 3,828,867 | A | | 8/1974 | Elwood | 175/45 |
| 3,874,413 | A | | 4/1975 | Valdez | 137/625.47 |
| 3,887,008 | A | | 6/1975 | Canfield | 166/267 |
| 3,902,322 | A | | 9/1975 | Watanabe | 61/35 |
| 3,934,649 | A | | 1/1976 | Pasini, III et al. | 166/254 |
| 3,957,082 | A | | 5/1976 | Fuson et al. | 137/625.41 |
| 3,961,824 | A | | 6/1976 | Van Eek et al. | 299/17 |
| 4,011,890 | A | | 3/1977 | Anderrson | 137/625.4 |
| 4,022,279 | A | | 5/1977 | Driver | 166/271 |
| 4,037,351 | A | | 7/1977 | Baum | 175/14 |
| 4,037,658 | A | | 7/1977 | Anderson | 166/272 |
| 4,089,374 | A | | 5/1978 | Terry | 166/259 |
| 4,116,012 | A | | 9/1978 | Abe et al. | 405/238 |
| 4,156,437 | A | | 5/1979 | Chivens et al. | 137/554 |
| 4,169,510 | A | | 10/1979 | Meigs | 175/65 |
| 4,189,184 | A | | 2/1980 | Green | 299/8 |
| 4,220,203 | A | | 9/1980 | Steeman | 166/271 |
| 4,221,433 | A | | 9/1980 | Jacoby | 299/4 |
| 4,257,650 | A | | 3/1981 | Allen | 299/2 |
| 4,278,137 | A | | 7/1981 | Van Eek, deceased | 175/267 |
| 4,283,088 | A | | 8/1981 | Tabakov et al. | 299/2 |
| 4,296,785 | A | | 10/1981 | Vitello et al. | 141/105 |
| 4,299,295 | A | | 11/1981 | Gossard | 175/45 |
| 4,303,127 | A | * | 12/1981 | Freel et al. | 166/266 |
| 4,305,464 | A | | 12/1981 | Masszi | 166/370 |
| 4,312,377 | A | | 1/1982 | Knecht | 137/625.19 |
| 4,317,492 | A | | 3/1982 | Summers et al. | 175/79 |
| 4,328,577 | A | | 5/1982 | Abbott et al. | 370/84 |
| 4,366,988 | A | | 1/1983 | Bodine | 299/14 |
| 4,372,398 | A | | 2/1983 | Kuckes | 175/45 |
| 4,386,665 | A | | 6/1983 | Dellinger | 175/61 |
| 4,390,067 | A | | 6/1983 | Willman | 166/245 |
| 4,396,076 | A | | 8/1983 | Inoue | 175/265 |
| 4,397,360 | A | | 8/1983 | Schmidt | 175/61 |
| 4,401,171 | A | | 8/1983 | Fuchs | 175/267 |
| 4,407,376 | A | | 10/1983 | Inoue | 175/267 |
| 4,442,896 | A | | 4/1984 | Reale et al. | 166/278 |
| 4,494,616 | A | | 1/1985 | McKee | 175/67 |
| 4,512,422 | A | | 4/1985 | Knisley | 175/99 |
| 4,519,463 | A | | 5/1985 | Schuh | 175/61 |
| 4,527,639 | A | | 7/1985 | Dickinson, III et al. | 175/61 |
| 4,532,986 | A | | 8/1985 | Mims et al. | 166/50 |
| 4,544,037 | A | | 10/1985 | Terry | 166/369 |
| 4,558,744 | A | | 12/1985 | Gibb | 166/335 |
| 4,565,252 | A | | 1/1986 | Campbell et al. | 175/269 |
| 4,573,541 | A | | 3/1986 | Josse et al. | 175/78 |
| 4,599,172 | A | | 7/1986 | Gardes | 210/314 |
| 4,600,061 | A | | 7/1986 | Richards | 175/62 |
| 4,605,076 | A | | 8/1986 | Goodhart | 175/61 |
| 4,611,855 | A | | 9/1986 | Richards | 299/2 |
| 4,618,009 | A | | 10/1986 | Carter et al. | 175/267 |
| 4,638,949 | A | | 1/1987 | Mancel | 239/307 |
| 4,646,836 | A | | 3/1987 | Goodhart | 166/303 |
| 4,674,579 | A | | 6/1987 | Geller et al. | 175/45 |
| 4,702,314 | A | | 10/1987 | Huang et al. | 166/245 |
| 4,705,431 | A | | 11/1987 | Gadelle et al. | 405/267 |
| 4,715,440 | A | | 12/1987 | Boxell et al. | 166/100 |
| 4,754,819 | A | | 7/1988 | Dellinger | 175/61 |
| 4,756,367 | A | | 7/1988 | Puri et al. | 166/263 |
| 4,763,734 | A | | 8/1988 | Dickinson et al. | 175/61 |
| 4,773,488 | A | | 9/1988 | Bell et al. | 175/61 |
| 4,830,105 | A | | 5/1989 | Petermann | 166/241 |
| 4,836,611 | A | | 6/1989 | El-Saie | 299/7 |
| 4,842,081 | A | | 6/1989 | Parant | 175/23 |
| 4,844,182 | A | | 7/1989 | Tolle | 175/215 |
| 4,852,666 | A | | 8/1989 | Brunet et al. | 175/61 |
| 4,883,122 | A | | 11/1989 | Puri et al. | 166/263 |
| 4,978,172 | A | | 12/1990 | Schwoebel et al. | 299/12 |
| 5,016,710 | A | | 5/1991 | Renard et al. | 166/245 |
| 5,035,605 | A | | 7/1991 | Dinerman et al. | 481/18 |
| 5,036,921 | A | | 8/1991 | Pittard et al. | 166/298 |
| 5,074,360 | A | | 12/1991 | Guinn | 166/281 |
| 5,074,365 | A | | 12/1991 | Kuckes | 175/40 |
| 5,074,366 | A | | 12/1991 | Karlsson et al. | 175/76 |
| 5,082,054 | A | | 1/1992 | Kiamanesh | 166/248 |
| 5,111,893 | A | | 5/1992 | Kvello-Aune | 175/258 |
| 5,121,244 | A | | 6/1992 | Takasaki | 359/161 |
| 5,135,058 | A | | 8/1992 | Millgard et al. | 175/71 |
| 5,148,875 | A | | 9/1992 | Karlsson et al. | 175/62 |
| 5,165,491 | A | | 11/1992 | Wilson | 175/62 |
| 5,168,942 | A | | 12/1992 | Wydrinski | 175/50 |
| 5,174,374 | A | | 12/1992 | Hailey | 166/55.8 |
| 5,193,620 | A | | 3/1993 | Braddick | 166/382 |
| 5,194,859 | A | | 3/1993 | Warren | 340/853.4 |
| 5,194,977 | A | | 3/1993 | Nishio | 359/128 |
| 5,197,553 | A | | 3/1993 | Leturno | 175/57 |
| 5,197,783 | A | | 3/1993 | Theimer et al. | 299/17 |
| 5,199,496 | A | | 4/1993 | Redus et al. | 166/366 |
| 5,201,817 | A | | 4/1993 | Hailey | 175/269 |
| 5,217,076 | A | | 6/1993 | Masek | 166/303 |
| 5,240,350 | A | | 8/1993 | Yamaguchi et al. | 405/143 |
| 5,242,017 | A | | 9/1993 | Hailey | 166/55.8 |
| 5,246,273 | A | | 9/1993 | Rosar | 299/4 |
| 5,255,741 | A | | 10/1993 | Alexander | 166/278 |
| 5,271,472 | A | | 12/1993 | Leturno | 175/107 |
| 5,301,760 | A | | 4/1994 | Graham | 175/61 |
| 5,363,927 | A | | 11/1994 | Frank | 175/67 |
| 5,385,205 | A | | 1/1995 | Hailey | 166/55.8 |
| 5,394,950 | A | | 3/1995 | Gardes | 175/45 |
| 5,402,851 | A | | 4/1995 | Baiton | 166/369 |
| 5,411,082 | A | | 5/1995 | Kennedy | 166/181 |
| 5,411,085 | A | | 5/1995 | Moore et al. | 166/242 |
| 5,411,104 | A | | 5/1995 | Stanley | 175/65 |
| 5,411,105 | A | | 5/1995 | Gray | 175/69 |
| 5,431,220 | A | | 7/1995 | Lennon et al. | 166/55.7 |
| 5,435,400 | A | | 7/1995 | Smith | 175/61 |
| 5,447,416 | A | | 9/1995 | Wittrisch | 417/442 |
| 5,450,902 | A | | 9/1995 | Matthews | 166/268 |
| 5,454,419 | A | | 10/1995 | Vloedman | 166/277 |
| 5,458,209 | A | | 10/1995 | Hayes et al. | 175/61 |
| 5,462,116 | A | | 10/1995 | Carroll | 166/249 |
| 5,462,120 | A | | 10/1995 | Gondouin | 166/380 |
| 5,469,155 | A | | 11/1995 | Archambeault et al. | 340/853.4 |
| 5,477,923 | A | | 12/1995 | Jordan, Jr. et al. | 66/313 |
| 5,485,089 | A | | 1/1996 | Kuckes | 324/346 |
| 5,494,121 | A | | 2/1996 | Nackerud | 175/263 |
| 5,501,273 | A | | 3/1996 | Puri | 166/252.5 |
| 5,501,279 | A | | 3/1996 | Garg et al. | 166/372 |
| 5,584,605 | A | | 12/1996 | Beard et al. | 405/128 |
| 5,613,242 | A | * | 3/1997 | Oddo | 588/17 |
| 5,615,739 | A | | 4/1997 | Dallas | 166/306 |
| 5,659,347 | A | | 8/1997 | Taylor | 347/85 |
| 5,669,444 | A | | 9/1997 | Riese et al. | 166/263 |
| 5,680,901 | A | | 10/1997 | Gardes | 166/313 |
| 5,690,390 | A | | 11/1997 | Bithell | 299/4 |
| 5,706,871 | A | | 1/1998 | Andersson et al. | 141/59 |
| 5,720,356 | A | | 2/1998 | Gardes | 175/62 |
| 5,727,629 | A | | 3/1998 | Blizzard, Jr. et al. | 166/298 |
| 5,735,350 | A | | 4/1998 | Longbottom et al. | 166/313 |

| | | | | |
|---|---|---|---|---|
| 5,771,976 | A | 6/1998 | Talley | 166/370 |
| 5,785,133 | A | 7/1998 | Murray et al. | 175/61 |
| 5,832,958 | A | 11/1998 | Cheng | 137/625.41 |
| 5,852,505 | A | 12/1998 | Li | 359/118 |
| 5,853,054 | A | 12/1998 | McGarian et al. | 175/267 |
| 5,853,056 | A | 12/1998 | Landers | 175/424 |
| 5,863,283 | A | 1/1999 | Gardes | 588/250 |
| 5,867,289 | A | 2/1999 | Gerstel et al. | 359/110 |
| 5,868,202 | A | 2/1999 | Hsu | 166/256 |
| 5,868,210 | A | 2/1999 | Johnson et al. | 175/40 |
| 5,879,057 | A | 3/1999 | Schwoebel et al. | 299/17 |
| 5,884,704 | A | 3/1999 | Longbottom et al. | 16/313 |
| 5,912,754 | A | 6/1999 | Koga et al. | 359/179 |
| 5,914,798 | A | 6/1999 | Liu | 359/161 |
| 5,917,325 | A | 6/1999 | Smith | 324/326 |
| 5,934,390 | A | 8/1999 | Uthe | 175/67 |
| 5,957,539 | A | 9/1999 | Durup et al. | 299/4 |
| 6,012,520 | A | 1/2000 | Yu et al. | 166/245 |
| 6,024,171 | A | 2/2000 | Montgomery et al. | 166/308 |
| 6,050,335 | A | 4/2000 | Parsons | 166/272.3 |
| 6,056,059 | A | 5/2000 | Ohmer | 166/313 |
| 6,065,550 | A | 5/2000 | Gardes | 175/62 |
| 6,119,771 | A | 9/2000 | Gano et al. | 166/50 |
| 6,135,208 | A | 10/2000 | Gano et al. | 166/313 |
| 6,280,000 | B1 | 8/2001 | Zupanick | 299/12 |
| 6,349,769 | B1 | 2/2002 | Ohmer | 166/313 |
| 6,357,523 | B1 | 3/2002 | Zupanick | 166/52 |
| 6,425,448 | B1 | 7/2002 | Zupanick et al. | 175/61 |
| 6,450,256 | B2 * | 9/2002 | Mones | 166/250.01 |

FOREIGN PATENT DOCUMENTS

| | | | |
|---|---|---|---|
| EP | 0 952 300 A1 | 10/1999 | E21B/7/12 |
| FR | 964503 | 4/1944 | 8/1 |
| GB | 2 347 157 A | 8/2000 | E21B/43/00 |
| WO | 94/21889 | 9/1994 | E21B/43/24 |
| WO | WO 99/60248 | 11/1999 | E21B/43/30 |
| WO | WO 00/31376 A2 * | 6/2000 | |
| WO | WO 00/31376 | 6/2000 | E21C/41/00 |
| WO | WO 00/79099 | 12/2000 | E21B/43/25 |
| WO | WO 02/059455 | 8/2002 | E21B/43/00 |

OTHER PUBLICATIONS

Joseph C. Stevens, Horizontal Applications for Coal Bed Methane Recovery, 3rd Annual Coalbed and Coal Mine Conference, *Strategic Research Institute*, pp. 1–10 slides, Mar. 25, 2002.

U.S. patent application Ser. No. 09/929,175, entitled "Pantograph Underreamer," filed Aug. 13, 2001, 24 pages.

U.S. patent application Ser. No. 09/929,568, entitled "Pantograph Underreamer," filed Aug. 13, 2001, 25 pages.

U.S. patent application Ser. No. 09/929,551, entitled "Pantograph Underreamer," filed Aug. 13, 2001, 27 pages.

U.S. patent application Ser. No. 10/079,444, entitled "Pantograph Underreamer," filed Feb. 19, 2002, 32 pages.

U.S. patent application Ser. No. 10/142,817, entitled "Method and System for Underground Treatment of Materials," filed May 8, 2002, 54 pgs.

Susan Eaton, "Reversal of Fortune", New Technology Magazine, pp. 30–31, Sep. 2002.

James Mahony, "A Shadow of Things to Come", New Technology Magazine, pp. 28–29, Sep. 2002.

Documents Received from Third Party, Great Lakes Directional Drilling, Inc., (12 pages), Received Sep. 12, 2002.

R.J. "Bob" Stayton, "Horizontal Wells Boost CBM Recovery", Special Report: Horizontal & Directional Drilling, *The American Oil & Gas Reporter*, pp. 71–75, Aug. 2002.

Kelley et al., U.S. patent application Publication No. US 2002/0074122 A1 Method and Apparatus for Hydrocarbon Subterranean Recover, Jun. 20, 2002.

Susan Eaton, "Reversal of Fortune", New Technology Magazine, pp. 30–31, Sep. 2002.

James Mahony "A Shadow of Things to Come", New Technology Magazine, pp. 28–29, Sep. 2002.

Documents Received from Third Party, Great Lakes Directional Drilling, Inc., (12 pages), Received Sep. 12, 2002.

Arfon H. Jones et al., "A Review of the Physical and Mechanical Properties of Coal with Implications for Coal-Bed Methane Well Completion and Production", *Rocky Mountain Association of Geologists*, pp. 169–181, 1988.

Joseph C. Stevens, Horizontal Applications for Coal Bed Methane Recovery, 3rd Annual Coalbed and Coal Mine Conference, *Strategic Research Institute*, pp. 1–10 slides, Mar. 25, 2002.

U.S. patent application Ser. No. 10/142,817, entitled "Method and System for Underground Treatment of Materials," filed May 8, 2002, 54 pgs., Aug. 13, 2001.

R.J. "Bob" Stayton, "Horizontal Wells Boost CBM Recovery", Special Report: Horizontal & Directional Drilling, *The American Oil & Gas Reporter*, pp. 71–75, Aug. 2002.

Kelley et al., U.S. patent application Publication No. US 2002/0074122 A1 Method and Apparatus for Hydrocarbon Subterranean Recover, Jun. 20, 2002.

McCray and Cole, "*Oil Well Drilling and Technology*," University of Oklahoma Press, pp. 315–319, 1959.

Berger and Anderson, "*Modern Petroleum*;" PennWell Books, pp. 106–108, 1978.

Howard L. Hartman, et al.; "*SME Mining Engineering Handbook*;" Society for Mining, Metallurgy, and Exploration, Inc.; pp. 1946–1950, 2nd Edition, vol. 2, 1992.

Dave Hassan, Mike Chernichen, Earl Jensen, and Morley Frank; "*Multi–lateral technique lowers drilling costs, provides environmental benefits*", Drilling Technology, pp. 41–47, Oct. 1999.

Pend. Pat. App., Joseph A. Zupanick, "*Method and System for Accessing Subterranean Deposits From The Surface*," U.S. patent application Ser. No. 09/444,029 (067083.0104), Nov. 19, 1999.

Joseph A. Zupanick; Declaration of Experimental Use, pp. 1–3, Nov. 12, 2000.

Pend Pat App, Joseph A. Zupanick "*Method and System for Enhanced Access to a Subterranean Zone*." U.S. patent application Ser. No. 09/769,098 (067083.0118), filed Jan. 24, 2001.

Pend Pat App, Joseph A. Zupanick et al., "*Method and System for Accessing Subterranean Zones From a Limited Surface Area*", U.S. patent application Ser. No. 09/773,217 (067083.0113, filed Jan. 30, 2001.

Pend Pat App, Joseph A. Zupanick et al., "*Method and System for Accessing a Subterranean Zone From a Limited Surface Area*," U.S. patent application Ser. No. 09/774,996 (067083.0120), filed Jan. 30, 2001.

Pend Pat App, Joseph A. Zupanick, "*Method and System for Accessing Subterranean Deposits From The Surface*," U.S. patent application Ser. No. 09/789,956 (067083.0137), filed Feb. 20, 2001.

Pend Pat App, Joseph A. Zupanick, "*Method and System for Accessing Subterranean Deposits From The Surface*," U.S. patent application Ser. No. 09/788,897 (067083.0138), filed Feb. 20, 2001.

Pend Pat App, Joseph A. Zupanick, "*Method and System for Accessing Subterranean Deposits From The Surface*," U.S. patent application Ser. No. 09/791,033 (067083.0139), filed Feb. 20, 2001.

Gopal Ramaswamy, "*Production History Provides CBM Insights*," Oil & Gas Journal pp. 49, 50 & 52, Apr. 2, 2001.

Pend Pat App, Joseph A. Zupanick, "*Method and System for Accessing Subterranean Deposits From The Surface*," SN 09/885,219 (067083.0140), filed Jun. 20, 2001.

Weiguo Chi & Luwu Yang, "*Feasibility of Coalbed Methane Exploitation in China*," Horizontal Well Technology, p. 74, Sep. 2001.

Nackerud Product Description, Received Sep. 27, 2001.

Gopal Ramaswamy, "*Advances Key For Coalbed Methane*," The American Oil & Gas Reporter, pp. 71 & 73, Oct. 2001.

Pend Pat App, Joseph A. Zupanick et al., "*Method and System for Management of By–Products From Subterranean Zones*," U.S. patent application Ser. No. (067083.0134), Oct. 19, 2001.

Pend Pat App, Joseph A. Zupanick, "Slant Entry Well System and Method," U.S. patent application Ser. No. 10/004,316 (067083.0162), Oct. 30, 2001.

Pend Pat App, Zupanick et al., "Method and System for Surface Production of Gas fro a Subterranean Zone," U.S. patent application Ser. No. 10/003,917 (067083.0161), Nov. 1, 2001.

Robert W. Taylor and Richard Russell, Multilateral Technologies Increase Operational Efficiencies in Middle East, Oil & Gas Journal, pp. 76–80, Mar. 16, 1998.

Adam Pasiczynk, "Evolution Simplifies Multilateral Wells", Directional Drilling, pp. 53–55, Jun. 2000.

Steven s. Bell, "Multilateral System with Full Re–Entry Access Installed", World Oil, p. 29, Jun. 1996.

P. Jackson and S. Kershaw, Reducing Long Term Methane Emissions Resulting from Coal Mining, Energy Convers. Mgmt, vol. 37, Nos 6–8, pp. 801–806, 1996.

Pascal Breant, "Des Puits Branches, Chez Total : les puits multi drains", Total Exploration Production, pp. 1–5, Jan. 1999.

* cited by examiner

METHOD AND SYSTEM FOR MANAGEMENT OF BY-PRODUCTS FROM SUBTERRANEAN ZONES

TECHNICAL FIELD OF THE INVENTION

The present invention relates generally to management of materials in or from the subsurface of the earth, and more particularly a method and system for management of by-products from subterranean zones.

BACKGROUND OF THE INVENTION

Production of petroleum and other valuable materials from subterranean zones frequently results in the production of water and other by-products that must be managed in some way. Such by-product water may be relatively clean, or may contain large amounts of brine or other materials. These by-products are typically disposed of by simply pouring them at the surfaces or, if required by environmental regulations, hauling them off-site at great expense.

SUMMARY OF THE INVENTION

The present invention provides an improved method and system for management of subterranean by-products that substantially eliminates or reduces the disadvantages and problems associated with previous systems and methods. In a particular embodiment, entrained water drained from a portion of the subterranean zone in the course of gas or other hydrocarbon production can be returned to or managed within the subterranean zone to reduce produced water that must be disposed of at the surface.

In accordance with one embodiment of the present invention, a method and system for management of subterranean by-products takes advantage of the force of gravity acting on fluids in a dipping subterranean zone, such that water produced as a by-product of coal methane gas production is returned to or kept in the subterranean zone and tends to flow downdip, though the drainage patterns towards previously drained areas and away from areas of current gas production.

In accordance with another aspect of the present invention, the drainage patterns may comprise a pattern which provides substantially uniform fluid flow within a subterranean area. Such a drainage pattern may comprise a main bore extending from a first end of an area in the subterranean zone to a distant end of the area, and at least one set of lateral bores extending outwardly from a side of the main bore.

Technical advantages of the present invention include a method and system for more effectively managing water produced as a by-product of coalbed methane gas and other resource production processes. For example, where it is acceptable to return the by-product water associated with gas or hydrocarbon production to, or keep the by-product water in, the subterranean zones, the present invention may reduce the cost of, and regulatory burdens associated with, managing the by-product water.

Another technical advantage of the present invention includes producing a method and system for producing gas in environmentally sensitive areas. Entrained water that must be removed as part of the production process may instead be managed in the subsurface. Thus, run off or trucking is minimized.

Certain embodiments may possess none, one, some, or all of these technical features and advantages and/or additional technical features and advantages.

Other technical advantages of the present invention will be readily apparent to one skilled in the art from the following figures, description, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Figure 1:
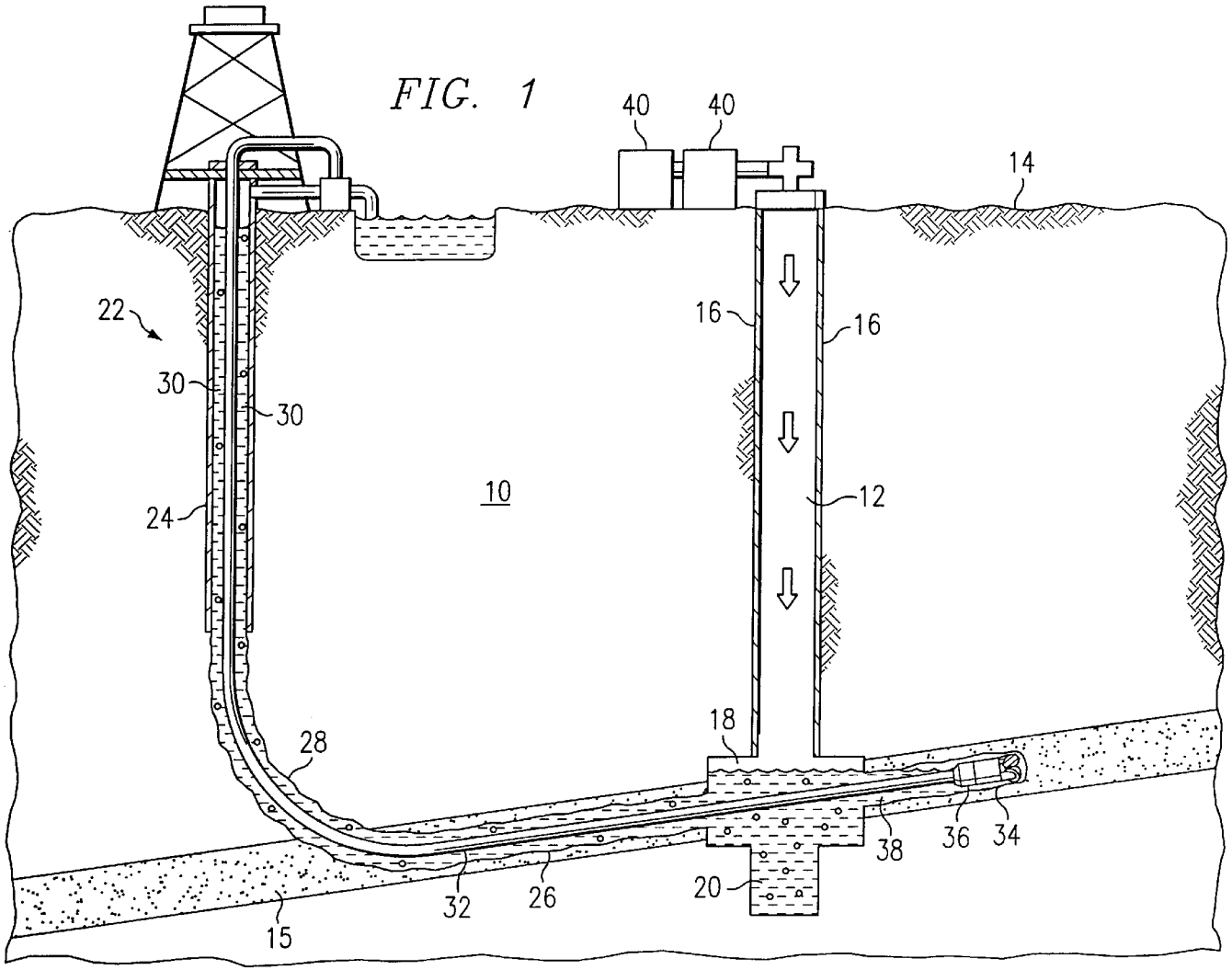
FIG. 1 is a cross-sectional diagram illustrating formation of a drainage pattern in a subterranean zone through an articulated surface well intersecting a vertical cavity well in accordance with one embodiment of the present invention.

FIG. 1 illustrates a well system in a subterranean zone in accordance with one embodiment of the present invention. A subterranean zone may comprise a coal seam, shale layer, petroleum reservoir, aquifer, geological layer or formation, or other at least partially definable natural or artificial zone at least partially beneath the surface of the earth, or a combination of a plurality of such zones. In this embodiment, the subterranean zone is a coal seam having a structural dip of approximately 0–20 degrees. It will be understood that other low pressure, ultra-low pressure, and low porosity formations, or other suitable subterranean zones, can be similarly accessed using the dual well system of the present invention to remove and/or produce water, hydrocarbons and other liquids in the zone, or to treat minerals in the zone. A well system comprises the well bores and the associated casing and other equipment and the drainage patterns formed by bores.

Referring to FIG. 1, a substantially vertical well bore 12 extends from the surface 14 to the target coal seam 15. The substantially vertical well bore 12 intersects, penetrates and continues below the coal seam 15. The substantially vertical well bore is lined with a suitable well casing 16 that terminates at or above the level of the coal seam 15. It will be understood that slanted or other wells that are not substantially vertical may instead be utilized if such wells are suitably provisioned to allow for the pumping of by-product.

The substantially vertical well bore 12 is logged either during or after drilling in order to locate the exact vertical depth of the coal seam 15 at the location of well bore 12. A dipmeter or similar downhole tool may be utilized to confirm the structural dip of the seam. As a result of these steps, the coal seam is not missed in subsequent drilling operations and techniques used to locate the seam 15 while drilling need not be employed. An enlarged-diameter cavity 18 is formed in the substantially vertical well bore 12 at the level of the coal seam 15. As described in more detail below, the enlarged-diameter cavity 18 provides a junction for intersection of the substantially vertical well bore by articulated well bore used to form a substantially dip-parallel drainage pattern in the coal seam 15. The enlarged-diameter cavity 18 also provides a collection point for by-product drained from the coal seam 15 during production operations.

In one embodiment, the enlarged-diameter cavity 18 has a radius of approximately two to eight feet and a vertical dimension of two to eight feet. The enlarged-diameter cavity 18 is formed using suitable under-reaming techniques and equipment such as a pantagraph-type cavity forming tool (wherein a slidably mounted coller and two or more jointed arms are pivotally fastened to one end of a longitudinal shaft such that, as the collar moves, the jointed arms extend radially from the centered shaft). A vertical portion of the substantially vertical well bore 12 continues below the enlarged-diameter cavity 18 to form a sump 20 for the cavity 18.

An articulated well bore 22 extends from the surface 14 to the enlarged-diameter cavity 18 of the substantially vertical well bore 12. The articulated well bore 22 includes a substantially vertical portion 24, a dip-parallel portion 26, and a curved or radiused portion 28 interconnecting the vertical and dip-parallel portions 24 and 26. The dip-parallel portion 26 lies substantially in the plane of the dipping coal seam 15 and intersects the large diameter cavity 18 of the substantially vertical well bore 12. It will be understood that the path of the dip-parallel portion 26 need not be straight and may have moderate angularities or bends without departing from the present invention.

The articulated well bore 22 is offset a sufficient distance from the substantially vertical well bore 12 at the surface 14 to permit the large radius curved section 28 and any desired dip-parallel section 26 to be drilled before intersecting the enlarged-diameter cavity 18. To provide the curved portion 28 with a radius of 100–150 feet, the articulated well bore 22 is offset a distance of about 300 feet from the substantially vertical well bore 12. This spacing minimizes the angle of the curved portion 28 to reduce friction in the bore 22 during drilling operations. As a result, reach of the drill string drilled through the articulated well bore 22 is maximized.

The articulated well bore 22 is drilled using a conventional drill string 32 that includes a suitable down-hole motor and bit 34. A measurement while drilling (MWD) device 36 is included in the drill string 32 for controlling the orientation and direction of the well bore drilled by the motor and bit 34 so as to, among other things, intersect with the enlarged-diameter cavity 18. The substantially vertical portion 24 of the articulated well bore 22 is lined with a suitable casing 30.

After the enlarged-diameter cavity 18 has been successfully intersected by the articulated well bore 22, drilling is continued through the cavity 18 using the drill string 32 and suitable drilling apparatus (such as a down-hole motor and bit) to provide a substantially dip-parallel drainage pattern 38 in the coal seam 15. During this operation, gamma ray logging tools and conventional measurement while drilling devices may be employed to control and direct the orientation of the drill bit to retain the drainage pattern 38 within the confines of the coal seam 15 and to provide substantially uniform coverage of a desired area within the coal seam 15. Further information regarding the drainage pattern is described in more detail below in connection with FIG. 3.

During the process of drilling the drainage pattern 38, drilling fluid or "mud" is pumped down the drill string 32 and circulated out of the drill string 32 in the vicinity of the bit 34, where it is used to scour the formation and to remove formation cuttings. The cuttings are then entrained in the drilling fluid which circulates up through the annulus between the drill string 32 and the well bore walls until it reaches the surface 14, where the cuttings are removed from the drilling fluid and the fluid is then recirculated. This conventional drilling operation produces a standard column of drilling fluid having a vertical height equal to the depth of the well bore 22 and produces a hydrostatic pressure on the well bore corresponding to the well bore depth. Because coal seams tend to be porous and fractured, they may be unable to sustain such hydrostatic pressure, even if formation water is also present in the coal seam 15. Accordingly, if the full hydrostatic pressure is allowed to act on the coal seam 15, the result may be loss of drilling fluid and entrained cuttings into the formation. Such a circumstance is referred to as an "over balanced" drilling operation in which the hydrostatic fluid pressure in the well bore exceeds the formation pressure. Loss of drilling fluid in cuttings into the formation not only is expensive in terms of the lost drilling fluid, which must be made up, but it tends to plug the pores in the coal seam 15, which are needed to drain the coal seam of gas and water.

To prevent over balance drilling conditions during formation of the drainage pattern 38, air compressors 40 are provided to circulate compressed air down the substantially vertical well bore 12 and back up through the articulated well bore 22. The circulated air will admix with the drilling fluids in the annulus around the drill string 32 and create bubbles throughout the column of drilling fluid. This has the effect of lightening the hydrostatic pressure of the drilling fluid and reducing the down-hole pressure sufficiently that drilling conditions do not become over balanced. Aeration of the drilling fluid reduces down-hole pressure to approximately 150–200 pounds per square inch (psi). Accordingly, low pressure coal seams and other subterranean zones can be drilled without substantial loss of drilling fluid and contamination of the zone by the drilling fluid.

Foam, which may be compressed air mixed with water, may also be circulated down through the drill string 32 along with the drilling mud in order to aerate the drilling fluid in the annulus as the articulated well bore 22 is being drilled and, if desired, as the drainage pattern 38 is being drilled. Drilling of the drainage pattern 38 with the use of an air hammer bit or an air-powered down-hole motor will also supply compressed air or foam to the drilling fluid. In this case, the compressed air or foam which is used to power the bit or down-hole motor exits the vicinity of the drill bit 34.

However, the larger volume of air which can be circulated down the substantially vertical well bore 12, permits greater aeration of the drilling fluid than generally is possible by air supplied through the drill string 32.

Figure 2:
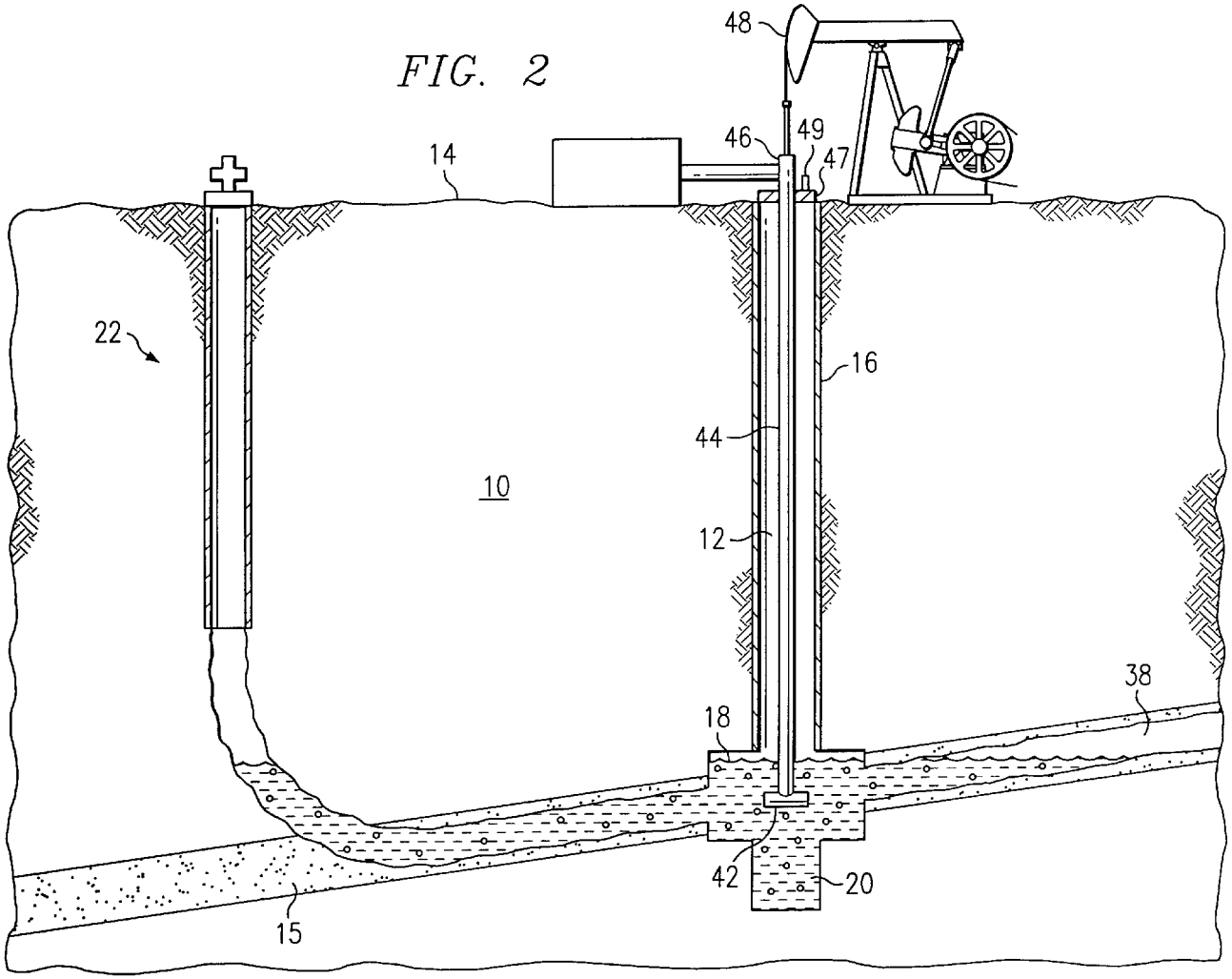
FIG. 2 is a cross-sectional diagram illustrating production of by-product and gas from a drainage pattern in a subterranean zone through a vertical well bore in accordance with one embodiment of the present invention.

FIG. 2 illustrates pumping of by-product from the dip-parallel drainage pattern 38 in the coal seam 15 in accordance with one embodiment of the present invention. In this embodiment, after the substantially vertical and articulated well bores 12 and 22 as well as drainage pattern 38 have been drilled, the drill string 32 is removed from the articulated well bore 22 and the articulated well bore is capped. Alternatively, the well bore may be left uncapped and used to drill other articulated wells.

Referring to FIG. 2, an inlet 42 is disposed in the substantially vertical well bore 12 in the enlarged-diameter cavity 18. The enlarged-diameter cavity 18 combined with the sump 20 provides a reservoir for accumulated by-product allowing intermittent pumping without adverse effects of a hydrostatic head caused by accumulated by-product in the well bore.

The inlet 42 is connected to the surface 14 via a tubing string 44 and may be powered by sucker rods 46 extending down through the well bore 12 of the tubing. The sucker rods 46 are reciprocated by a suitable surface mounted apparatus, such as a powered walking beam pump 48. The pump 48 may be used to remove water from the coal seam 15 via the drainage pattern 38 and inlet 42.

When removal of entrained water results in a sufficient drop in the pressure of the coal seam 15, pure coal seam gas may be allowed to flow to the surface 14 through the annulus of the substantially vertical well bore 12 around the tubing string 44 and removed via piping attached to a wellhead apparatus. A cap 47 over the well bore 12 and around the tubing string 44 may aid in the capture of gas which can then be removed via outlet 49. At the surface, the methane is treated, compressed and pumped through a pipeline for use as a fuel in a conventional manner. The pump 48 may be operated continuously or as needed.

As described in further detail below, water removed from the coal seam 15 may be released on the ground or disposed of off-site. Alternatively, as discussed further below, the water the may be returned to the subsurface and allowed to enter the subterranean zone through previously drilled, down-dip drainage patterns.

Figure 3:
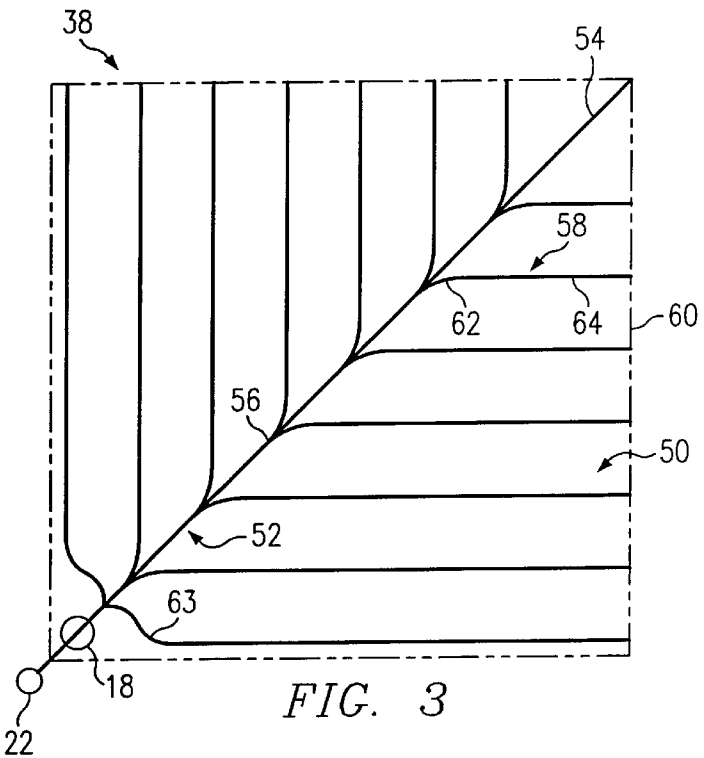
FIG. 3 is a top plan diagram illustrating a pinnate drainage pattern for accessing a subterranean zone in accordance with one embodiment of the present invention.

FIG. 3 a top plan diagram illustrating a substantially dip-parallel, pinnate drainage pattern for accessing deposits in a subterranean zone in accordance with one embodiment of the present invention in accordance with one embodiment of the present invention. In this embodiment, the drainage pattern comprises a pinnate patterns that have a central diagonal with generally symmetrically arranged and appropriately spaced laterals extending from each side of the diagonal. As used herein, the term each means every one of at least a subset of the identified items. The pinnate pattern approximates the pattern of veins in a leaf or the design of a feather in that it has similar, substantially parallel, auxiliary drainage bores arranged in substantially equal and parallel spacing or opposite sides of an axis. The pinnate drainage pattern with its central bore and generally symmetrically arranged and appropriately spaced auxiliary drainage bores on each side provides a uniform pattern for draining by-product from a coal seam or other subterranean formation. With such a pattern, 80% or more of the by-product present in a given zone of a coal seam may be feasibly removable, depending upon the geologic and hydrologic conditions. The pinnate pattern provides substantially uniform coverage of a square, other quadrilateral, or grid area and may be aligned with longwall mining panels for preparing the coal seam 15 for mining operations. It will be understood that other suitable drainage patterns may be used in accordance with the present invention.

Referring to FIG. 3, the enlarged-diameter cavity 18 defines a first corner of the area 50. The pinnate pattern 38 includes a main well bore 52 extending diagonally across the area 50 to a distant corner 54 of the area 50. The diagonal bore 52 is drilled using the drill string 32 and extends from the enlarged cavity 18 in alignment with the articulated well bore 22.

A plurality of lateral well bores 58 extend from the opposites sides of diagonal bore 52 to a periphery 60 of the area 50. The lateral bores 58 may mirror each other on opposite sides of the diagonal bore 52 or may be offset from each other along the diagonal bore 52. Each of the lateral bores 58 includes a first radius curving portion 62 extending from the well bore 52, and an elongated portion 64. The first set of lateral well bores 58 located proximate to the cavity 18 may also include a second radius curving portion 63 formed after the first curved portion 62 has reached a desired orientation. In this set, the elongated portion 64 is formed after the second curved portion 63 has reached a desired orientation. Thus, the first set of lateral well bores 58 kicks or turns back towards the enlarged cavity 18 before extending outward through the formation, thereby extending the drainage area back towards the cavity 18 to provide uniform coverage of the area 50. For uniform coverage of a square area 50, in a particular embodiment, pairs of lateral well bores 58 are substantially evenly spaced on each side of the well bore 52 and extend from the well bore 52 at an angle of approximately 45 degrees. The lateral well bores 58 shorten in length based on progression away from the enlarged cavity 18 in order to facilitate drilling of the lateral well bores 58.

The pinnate drainage pattern 38 using a single diagonal bore 52 and five pairs of lateral bores 58 may drain a coal seam area of approximately 150–200 acres in size. Where a smaller area is to be drained, or where the coal seam has a different shape, such as a long, narrow shape or due to surface or subterranean topography, alternate pinnate drainage patterns may be employed by varying the angle of the lateral bores 110 to the diagonal bore 52 and the orientation of the lateral bores 58. Alternatively, lateral bores 58 can be drilled from only one side of the diagonal bore 52 to form a one-half pinnate pattern.

The diagonal bore 52 and the lateral bores 58 are formed by drilling through the enlarged-diameter cavity 18 using the drill string 32 and appropriate drilling apparatus (such as a downhole motor and bit). During this operation, gamma ray logging tools and conventional measurement while drilling technologies may be employed to control the direction and orientation of the drill bit so as to retain the drainage pattern within the confines of the coal seam 15 and to maintain proper spacing and orientation of the diagonal and lateral bores 52 and 58.

In a particular embodiment, the diagonal bore 52 is drilled with an inclined hump at each of a plurality of lateral kick-off points 56. After the diagonal 52 is complete, the drill string 32 is backed up to each successive lateral point 56 from which a lateral bore 110 is drilled on each side of the diagonal 52. It will be understood that the pinnate drainage pattern 38 may be otherwise suitably formed in accordance with the present invention.

Figure 4A:
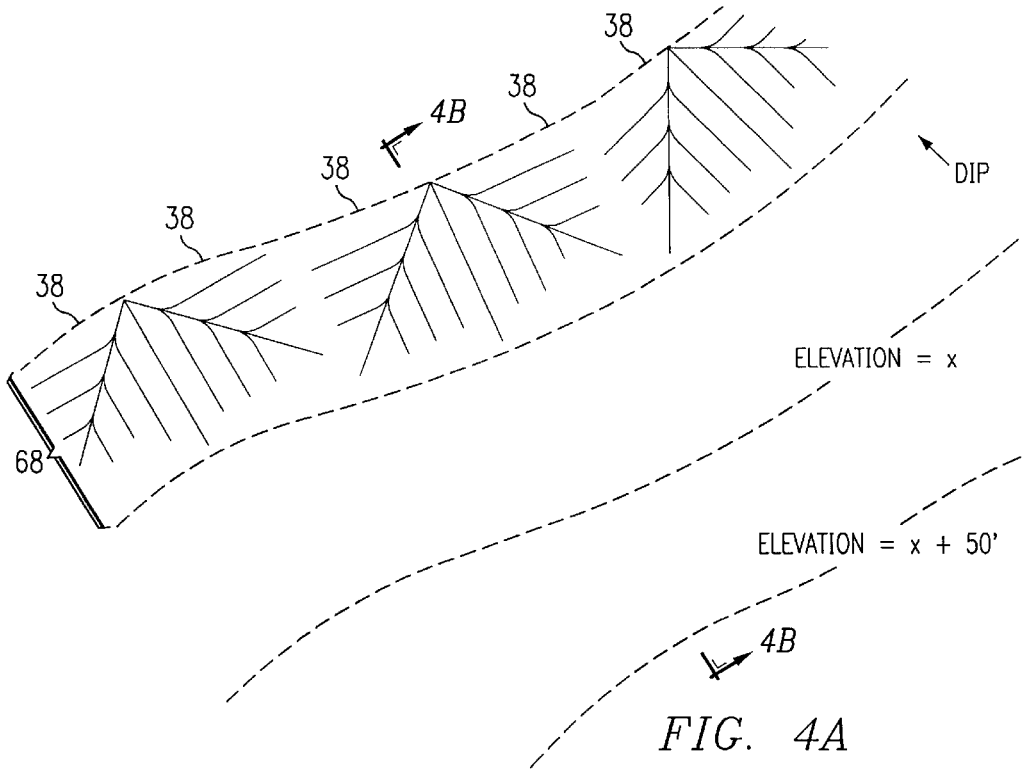
FIGS. 4A–4B illustrate top-down and cross-sectional views of a first set of drainage patters for producing gas from dipping subterranean zone in accordance with one embodiment of the present invention.
Figure 4B:
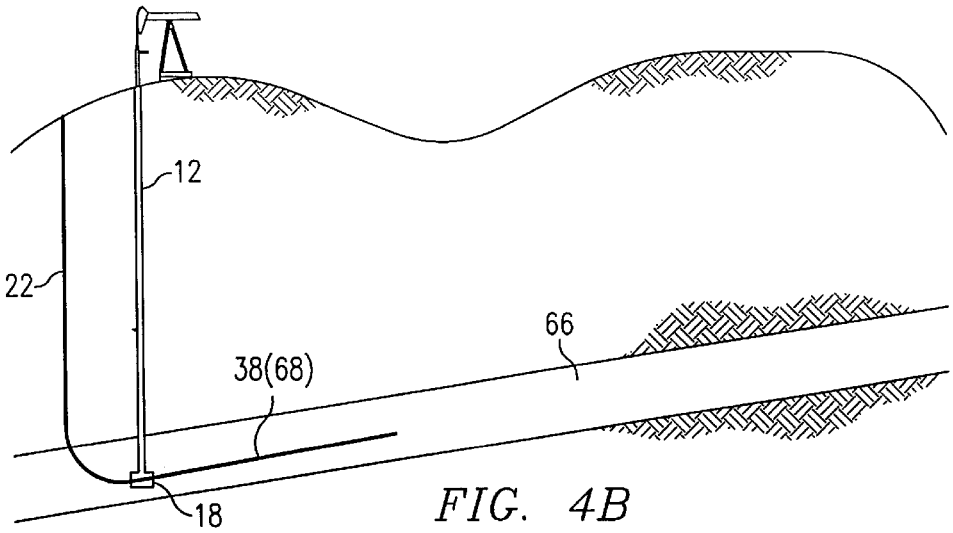

FIGS. 4A–4B illustrate top-down and cross-sectional views of a dipping subterranean zone comprising a coal seam and a first well system at a down-dip point of the subterranean zone at Time (1) in accordance with one embodiment of the present invention.

Referring to FIGS. 4A–4B, the dipping coal seam 66 is drained by, and gas produced from, a first well system 68 comprising drainage patterns 38. It will be understood that the pinnate structure shown in FIG. 3 or other suitable patterns may comprise the drainage patterns 38. In a particular embodiment, the system 68 is formed with pairs of pinnate drainage patterns 38 as shown in FIG. 3, each pair having main bores 56 meeting at a common point downdip. The main bores 56 extend updip, subparallel to the dip direction, such that one pair of the lateral well bores 58 runs substantially parallel with the dip direction, and the other set of lateral well bores 58 runs substantially perpendicular to the dip direction (i.e., substantially parallel to the strike direction). In this way, the drainage patterns 38 of the series 68 form a substantially uniform coverage area along the strike of the coal seam.

Water is removed from the coal seam from and around the area covered by the system 68 through the vertical bores 12, as described in reference to FIG. 2 or using other suitable means. This water may be released at the surface or trucked off-site for disposal. When sufficient water has been removed to allow for coalbed methane gas production, gas production from the system 68 progresses through the vertical bore 12. The wells, cavity drainage pattern and/or pump is/are sized to remove water from the first portion and to remove recharge water from other portions of the coal seam 66 or other formations. Recharge amounts may be dependent on the angle and permeability of the seam, fractures and the like.

Figure 5A:
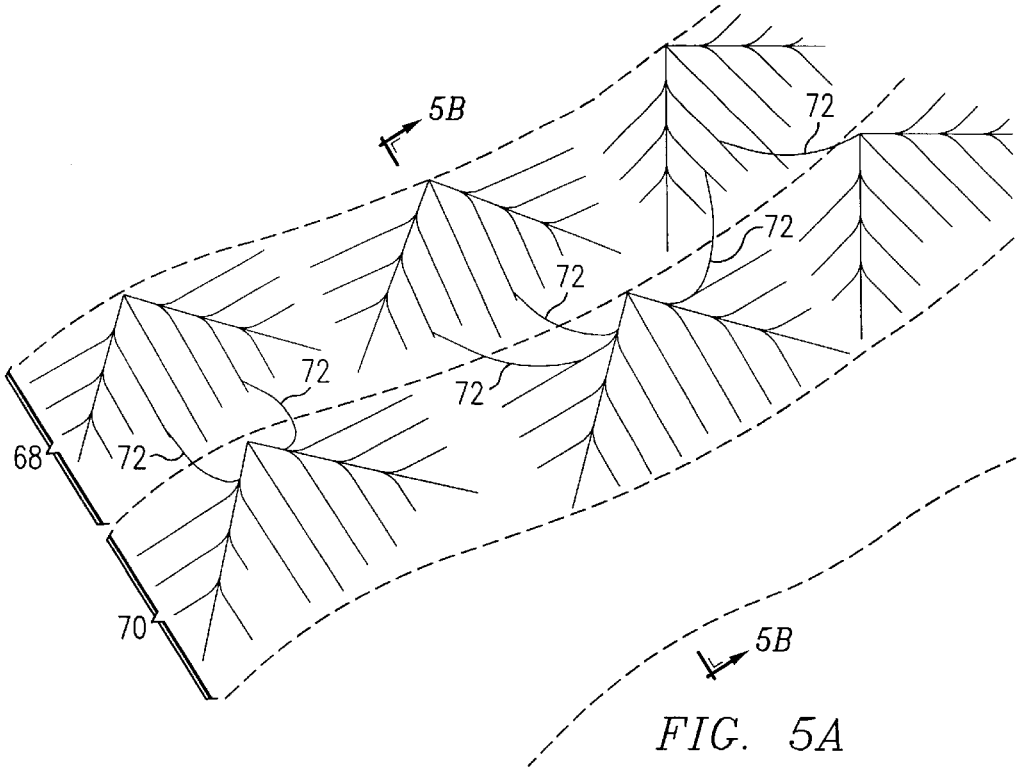
FIGS. 5A–5B illustrate top-down and cross-sectional views of the first set of drainage patterns and a second set of interconnected drainage patterns for producing gas from the dipping subterranean zone of FIG. 4 at Time (2) in accordance with one embodiment of the present invention.
Figure 5B:
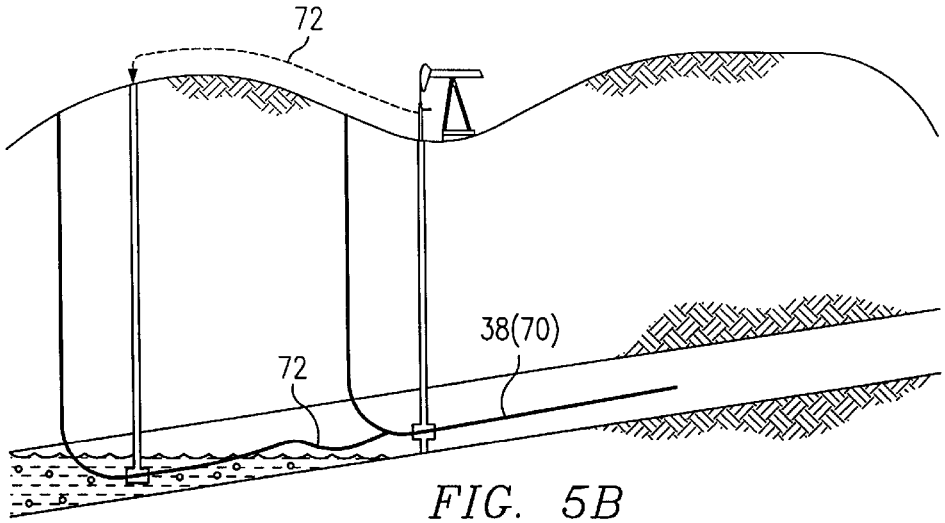

FIGS. 5A–5B illustrate top-down and cross-sectional views of the dipping subterranean zone of FIG. 4 at Time (2) in accordance with one embodiment of the present invention.

Referring to FIGS. 5A–5B, the area covered by well series 68 may be depleted of gas. Time (2) may be a year after Time (1), or may represent a greater or lesser interval. A second well system 70 comprising drainage patterns 38 is formed updip of the terminus of the system 68 drainage patterns. The system 70 is formed in a similar manner as the system 68, such that the drainage patterns 38 of the system 70 form a substantially uniform coverage area along the strike of the coal seam.

A series of subterranean hydraulic connections 72 may be formed, connecting the system 68 with the system 70. The hydraulic connections may comprise piping, well bore segments, mechanically or chemically enhanced faults, fractures, pores, or permeable zones, or other connections allowing water to travel through the subterranean zone. Some embodiments of the present invention may only use surface production and reinjection. In this latter embodiment, the hydraulic connection may comprise piping and storage tanks that may not be continuously connected at any one time.

The hydraulic connection 72 could be drilled utilizing either the well bores of the system 68 or the well bores of system 70. Using the force of gravity, the connection 72 allows water to flow from the area of system 70 to the area of system 68. If such gravity flow did not result in sufficient water being removed from the system 70 area for gas production from the system 70 area, pumping could raise additional water to the surface to be returned to the subsurface either immediately or after having been stored temporarily and/or processed. The water would be returned to the subsurface coal seam via the well bores of system 70, and a portion of that water may flow through the connection 72 and into the coal seam via the drainage areas of system 68. When sufficient water has been removed to allow for coalbed methane gas production, gas production from the system 70 progresses through the vertical bore 12.

Figure 6A:
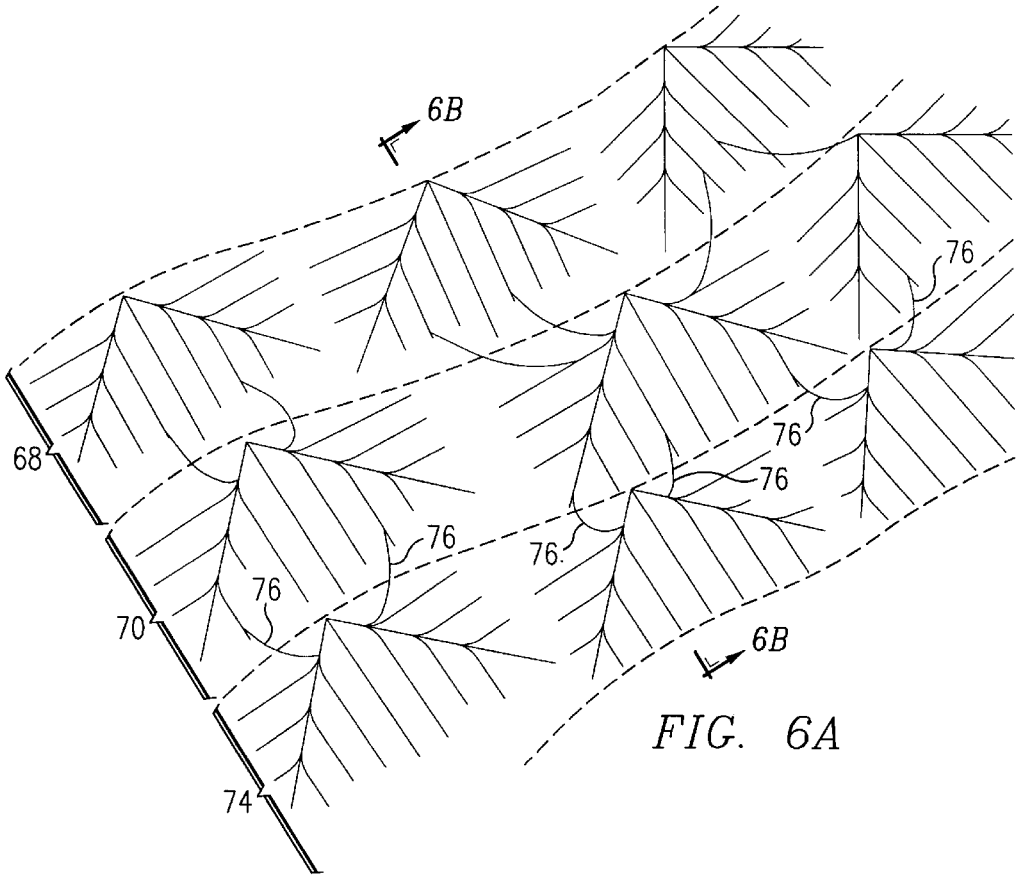
FIGS. 6A–6B illustrate top-down and cross-sectional views of the first and second set of interconnected drainage patterns and a third set of interconnected drainage patterns for providing gas from the dipping subterranean zone of FIG. 4 at Time (3) in accordance with one embodiment of the present invention.
Figure 6B:
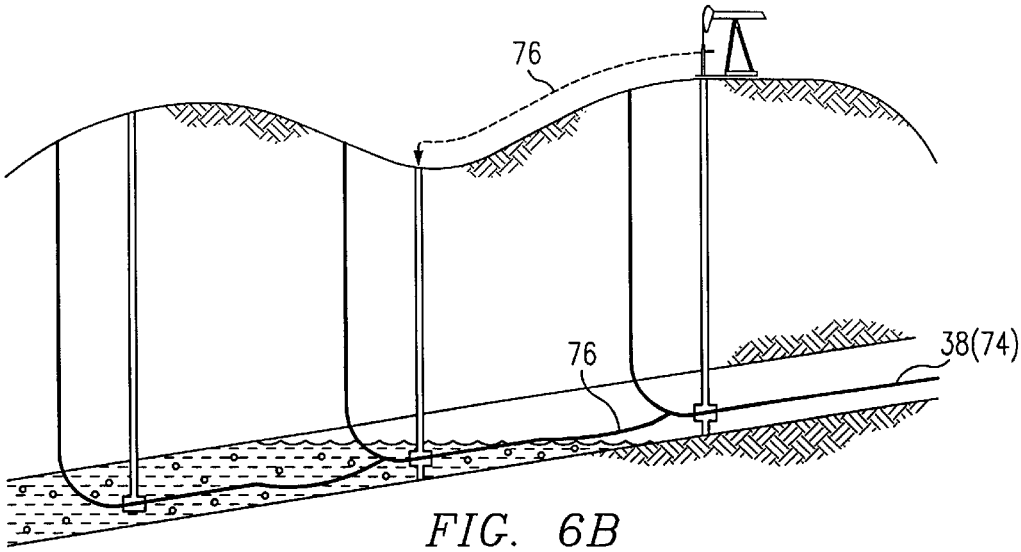

FIGS. 6A–6B illustrate top-down and cross-sectional views of the dipping subterranean zone of FIG. 4 at Time (3) in accordance with one embodiment of the present invention.

Referring to FIGS. 6A–6B, the area covered by the system 68 and by system 70 may be depleted of gas. Time (3) may be a year after Time (2), or may represent a greater or lesser interval. A third well system 74 comprising drainage patterns 38 is formed updip of the terminus of the system 70 drainage patterns. The system 74 is formed in a similar manner as the system 68 and 70, such that the drainage patterns 38 of the system 74 form a substantially uniform coverage area along the strike of the coal seam.

A series of subterranean hydraulic connections 76 would be formed, connecting the systems 68 and 70 with the system 74. The connection 76 could be drilled utilizing either the well bores of the system 70 or the well bores of system 74. Assisted by the force of gravity, the connection 76 would allow water to flow from the area of system 74 to the area of system 68 and 70. If such gravity flow did not result in sufficient water being removed from the system 74 area for gas production from the system 74 area, pumping could raise additional water to the surface to be returned to the subsurface either immediately or after having been stored temporarily. The water would be returned to the subsurface coal seam via the well bores of system 74, and a portion of that water may flow through the connection 72 and into the coal seam via the drainage areas of systems 68 and 70. When sufficient water has been removed to allow for coalbed methane gas production, gas production from the system 74 progresses through the vertical bores 12.

Figure 7:
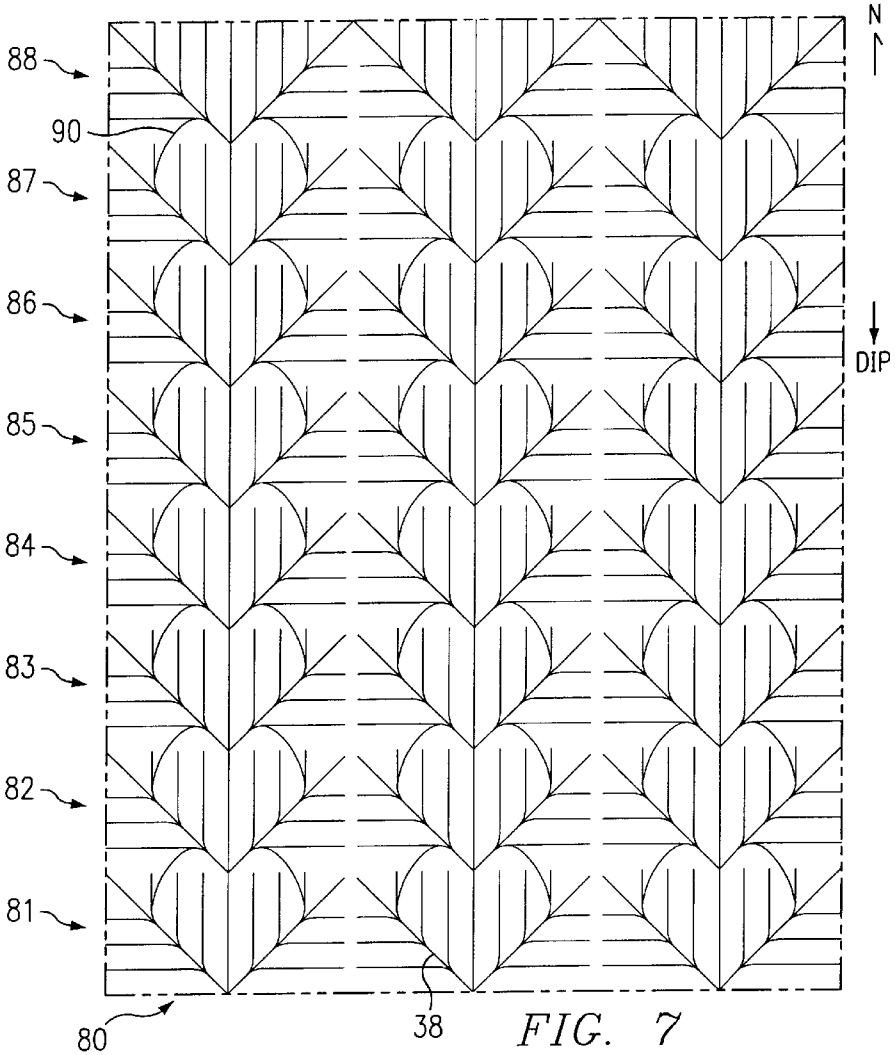
FIG. 7 illustrates top-down view of a field of interconnecting drainage patters for producing gas from a dipping subterranean zone comprising a coal seam in accordance with one embodiment of the present invention.

FIG. 7 illustrates top-down view of a field comprising a dipping subterranean zone comprising a coal seam in accordance with one embodiment of the present invention.

Referring to FIG. 7, coalbed methane gas from the south-dipping coal seam in the field 80 has been produced from eight well systems 81, 82, 83, 84, 85, 86, 87, and 88. The well systems each comprise 6 drainage patterns 38, each of which individually cover an area of approximately 150–200 acres. Thus, the field 80 covers a total area of approximately 7200–9600 acres. In this embodiment, well system 81 would have been drilled and produced from over the course of a first year of exploitation of the field 80. Each of the well systems systems 81, 82, 83, 84, 85, 86, 87, and 88 may comprise a year's worth of drilling and pumping; thus, the field 80 may be substantially depleted over an eight-year period. At some point or points during the course of each year, connections 90 are made between the drainage patterns 38 of the newly drilled well system and those of the down-dip well system to allow water to be moved from the subterranean volume of the newly drilled well system to the subterranean volume of the down-dip will system.

In one embodiment, for a field comprising a plurality of well systems, each of which may comprise a plurality of drainage patterns covering about 150–200 acres, at least about 80% of the gas in the subterranean zone of the field can be produced. After the initial removal and disposal of the by-product from the first well system, the substantially uniform fluid flow and drainage pattern allows for substantially all of the by-product water to be managed or re-injected within the subterranean zone.

Figure 8:
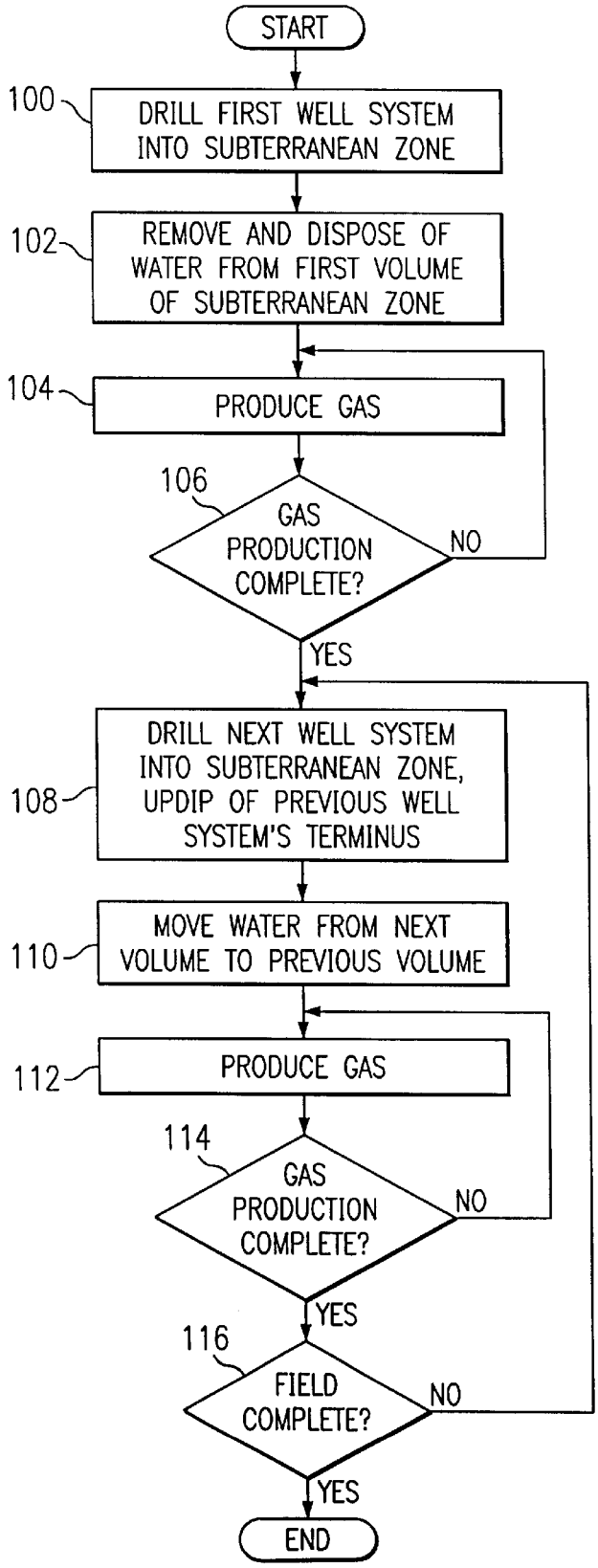
FIG. 8 is a flow diagram illustrating a method for management of by-products from subterranean zones in accordance with one embodiment of the present invention.

FIG. 8 is a flow diagram illustrating a method for management of by-products from subterranean zones in accordance with one embodiment of the present invention.

Referring to FIG. 8, the method begins at step 100, in which a first well system is drilled into a subterranean zone. The well system may comprise one or more drainage patterns, and may comprise a series of drainage patterns arranged as described in FIGS. 4–6, above. The well system may comprise a dual-well system as described in reference to FIGS. 1–2 or may comprise another suitable well system.

At step 102, water is removed from a first volume of the subterranean zone via pumping to the surface or other suitable means. The first volume of the subterranean zone may comprise a portion of the volume comprising the area covered by the drainage patterns of the well system multiplied by the vertical height of the subterranean zone (for example, the height of the coal seam) within that area. The water removed at step 102 may be disposed of in a conventional manner, such as disposing of the water at the surface, if environmental regulations permit, or hauling the water off-site.

At step 104, gas is produced from the subterranean zone when sufficient water has been removed from the first volume of the subterranean zone. At decisional step 106, it is determined whether gas production is complete. Completion of gas production may take months or a year or longer. During gas production, additional water may have to be removed from the subterranean zone. As long is gas production continues, the Yes branch of decisional step 106 returns to step 104.

When gas production is determined to be complete (or, in other embodiments, during a decline in gas production or at another suitable time), the method proceeds to step 108 wherein a next well system is drilled into the subterranean zone, updip of the previous well system's terminus. At step 110, water is moved from the next volume of the subterranean zone via pumping or other means, to the previous zone. The next volume of the subterranean zone may comprise a portion of the volume comprising the area covered by the drainage patterns of newly drilled well system multiplied by the vertical height of the subterranean zone at that area. The moving of the water from the newly drilled volume may be accomplished by forming a hydraulic connection between the well systems. If the hydraulic connection is subsurface (for example, within the subterranean zone), and depending upon the geologic conditions, the movement of the water may occur through subsurface connection due to the force of gravity acting on the water. Otherwise, some pumping or other means may be utilized to aid the water's movement to the previously drained volume. Alternatively, the water from the newly-drilled volume could be pumped to the surface, temporarily stored, and then re-injected into the subterranean zone via one of the well systems. At the surface, pumped water may be temporarily stored and/or processed.

It will be understood that, in other embodiments, the pumped water or other by-product from the next well may be placed in previously drained well systems not down dip from the next well, but instead cross-dip or updip from the next well. For example, it may be appropriate to add water to a previously water-drained well system updip, if the geologic permeability of the subterreanean zone is low enough to prevent rapid downdip movement of the re-injected water from the updip well system. In such conditions and in such an embodiment, the present invention would also allow sequential well systems to be drilled in down-dip direction (instead of a sequential up-dip direction as described in reference to FIG. 8) and by-product managed in accordance with the present invention.

At step 112, gas is produced from the subterranean zone when sufficient water has been removed from the newly drilled volume of the subterranean zone. At decisional step 114, it is determined whether gas production is complete. Completion of gas production may take months or a year or longer. During gas production, additional water may have to be removed from the subterranean zone. Gas production continues (i.e., the method returns to step 112) if gas production is determined not to be complete.

If completion of gas production from the newly drilled well system completes the field (i.e., that area of the resource-containing subterranean zone to be exploited), then at decisional step 116 the method has reached its end. If, updip, further areas of the field remain to be exploited, then the method returns to step 108 for further drilling, water movement, and gas production.

Although the present invention has been described with several embodiments, various changes and modifications may be suggested to one skilled in the art. It is intended that the present invention encompass such changes and modifications as fall within the scope of the appended claims.

What is claimed is:

1. A method for management of subterranean by-product, comprising:

drilling a first well system into a subterranean zone, wherein the first well system comprises a first drainage pattern;

removing via the first well system by-product from a first volume of the subterranean zone;

producing gas from the first volume of the subterranean zone;

drilling a second well system into the subterranean zone, wherein the second well system comprises a second drainage pattern;

forming a subsurface hydraulic connection between the first drainage pattern and the second drainage pattern;

moving by-product from a second volume of the subterranean zone to the first volume of the subterranean zone; and producing gas from the second volume of the subterranean zone.

2. The method of claim 1, wherein the subterranean zone has an initial formation pressure below 250 pounds per square inch (psi).

3. The method of claim 1, wherein the subterranean zone has an initial formation pressure below 150 pounds per square inch (psi).

4. The method of claim 1, wherein at least one of the drainage patterns comprises a main bore with a plurality of lateral bores.

5. The method of claim 1, wherein at least one of the drainage patterns provides substantially uniform fluid flow within a subterranean area.

6. The method of claim 1, wherein at least one of the drainage patterns comprises a main bore extending from a first end of an area in the subterranean zone to a distant end of the area, and at least one set of lateral bores extending outwardly from a side of the main bore.

7. The method of claim 6, wherein the lateral well bores progressively shorten as a distance between a respective lateral well bore and the first end increases.

8. The method of claim 1, wherein the subterranean zone comprises a coal seam, the by-product comprises water, and the gas comprises coalbed methane.

9. The method of claim 1, wherein the second well system is substantially updip of the first well system.

10. The method of claim 1, wherein a majority of the by-product feasibly removable from the second volume is moved from the second volume of the subterranean zone to the first volume of the subterranean zone.

11. The method of claim 1, wherein the moving by-product from a second volume of the subterranean zone to the first volume of the subterranean zone is by pumping the by-product from the second volume to the surface followed by re-injecting the by-product into the first volume.

12. The method of claim 11, wherein the pumping is via a pump, an inlet of which is disposed in an enlarged cavity formed in a well-bore and the pump operable to pump fluid accumulated in the enlarged cavity to the surface.

13. A method for management of subterranean by-product, comprising:

drilling a first well system into a subterranean zone, the subterranean zone having a structural dip, wherein the first well system comprises a first substantially dip-parallel drainage pattern extending updip in the subterranean zone and ending at a first terminus;

removing via the first well system by-product from a first volume of the subterranean zone to allow gas production from the first volume;

producing gas from the first volume via the first well system;

drilling a second well system into the subterranean zone, wherein the second well system comprises a second substantially dip-parallel drainage pattern extending updip in the subterranean zone and updip of the first terminus and ending at a second terminus; and moving via the first well system and the second well system by-product from a second volume of the subterranean zone to the first volume of the subterranean zone; and producing gas from the second volume of the subterranean zone via the second well system.

14. The method of claim 13, wherein the moving comprises removing to the surface the fluid from the second volume and causing the fluid to flow from the surface to the first volume of the subterranean zone.

15. The method of claim 14, wherein the flow from the surface to the first volume of the subterranean zone is via the first well system.

16. The method of claim 13, wherein the moving comprises forming a hydraulic connection between the first substantially dip-parallel drainage pattern and the second substantially dip-parallel drainage pattern.

17. The method of claim 13, wherein the hydraulic connection is subsurface.

18. The method of claim 17, further comprising:

drilling a third well system into the subterranean zone, wherein the third well system comprises a third substantially dip-parallel drainage pattern extending updip in the subterranean zone and updip from the second terminus; and moving by-product from a third volume of the subterranean zone to at least one of the first and second volume of the subterranean zone.

19. The method of claim 18, wherein the moving comprises removing to the surface the fluid from the third volume of the subterranean zone and causing the fluid to flow from the surface to at least one of the first and second volume of the subterranean zone.

20. The method of claim 19, wherein the flow from the surface to at least one of the first and second volume of the subterranean zones is via the first or second well system.

21. The method of claim 18, wherein the moving comprises forming a hydraulic connection between the first substantially dip-parallel drainage pattern and the second substantially dip-parallel drainage pattern.

22. The method of claim 21, wherein the hydraulic connection is subsurface.

23. The method of claim 13, wherein at least one of the substantially dip-parallel drainage patterns comprises a main bore with a plurality of lateral bores.

24. The method of claim 13, wherein at least one of the substantially dip-parallel drainage patterns provides substantially uniform fluid flow within a subterranean area.

25. The method of claim 13, wherein at least one of the substantially dip-parallel drainage patterns comprises a main bore extending from a first end of an area in the subterranean zone to a distant end of the area, and at least one set of lateral bores extending outwardly from a side of the main bore.

26. The method of claim 13, wherein the subterranean zone comprises a coal seam, the by-product comprises water, and the gas comprises coalbed methane.

27. The method of claim 13, wherein the drainage patterns each comprise an area of about 150–200 acres.

28. The method of claim 13, wherein at least 80% of the gas in the first and second volumes of the subterranean zone is produced and wherein substantially all of the by-product from the second volume of the subterranean zone is moved back into the subterranean zone.

* * * * *